United States Patent [19]

Huffman

[11] 4,298,798

[45] Nov. 3, 1981

[54] METHOD AND APPARATUS FOR PRODUCING NEGATIVE IONS

[75] Inventor: Fred N. Huffman, Sudbury, Mass.

[73] Assignee: Thermo Electron Corporation, Waltham, Mass.

[21] Appl. No.: 98,423

[22] Filed: Nov. 29, 1979

[51] Int. Cl.[3] ..... H01J 27/00

[52] U.S. Cl. ..... 250/423 R; 313/363.1

[58] Field of Search ..... 250/423, 424, 425; 313/355, 359, 362, 363

[56] References Cited

U.S. PATENT DOCUMENTS 4,093,858 6/1978 Kobayashi et al. ..... 250/425

OTHER PUBLICATIONS

"D Production by Backscattering from Clean Alkali--Metal Surfaces", Schneider et al., Proceedings of the Symposium of Production and Neutralization of Negative Hydrogen Ions & Beams, Sep. 1977, pp. 63-69.

"Low-Work-Function Surfaces Produced by $CS_2CO_3$ Decomposition", Brieve et al., J. of Applied Physics, vol. 48, No. 8, Aug. 77, pp. 3547-3550.

"Negative D-Ion Source", NASA Tech. Brief, NTN 78/0633, NPO-14113.

*Primary Examiner*—Bruce C. Anderson

*Attorney, Agent, or Firm*—Herbert E. Messenger; James L. Neal

[57] ABSTRACT

A method and apparatus are described for producing negative deuterium ions for use in controlled thermonuclear reactions such as fusion. Negative ions are obtained by bombarding the surface of an ionization electrode with positive ions and extracting negative ions from the electrode. The unique surface layer of the electrode is formed by depositing onto a substrate the products of thermal decomposition of cesium carbonate. This layer, which is easily formed and renewed, is characterized by a very low value of work function of about 1.05 electron volts, which facilitates formation of large quantities of negative ions. Properties of the surface layer, particularly the low value of work function, are reproducible and relatively insensitive to variations in the thickness of the layer and to the substrate material selected for the electrode.

8 Claims, 5 Drawing Figures

METHOD AND APPARATUS FOR PRODUCING NEGATIVE IONS

BACKGROUND OF THE INVENTION

High energy beams of neutral particles such as deuterium and tritium are of interest as fuels in controlled thermonuclear reactions such as fusion. To generate these intense high energy beams, ions are produced and accelerated to the required energy, then neutralized by stripping in a gas, metal vapor, or plasma jet. Negative ions are preferred since the neutralization efficiency is higher for negative ions than for positive ions at the energy levels of interest i.e., at energies greater than 100 keV.

Some experimental work has been performed to produce negative ions by preparing a target having a thick layer of an alkali metal, and bombarding the surface of the target with positive deuterium or tritium ions. Some of the positive ions interact with the target to pick up two electrons and then emerge upon reflection as negative ions. In another method, negative deuterium ions are produced by directing a flow of neutral deuterium atoms into a porous electrode containing a surface layer of barium oxide. Some of the neutral atoms pick up a single electron in passing through the electrode and then emerge as negative ions. Thus far, however, the negative ion currents achieved by these techniques have been impractically low. Formation and maintenance of the desired target surfaces has also proven difficult.

Accordingly, it is an object of the invention to provide a method and apparatus for producing negative ions.

It is a more particular object of the invention to provide improved methods and apparatus for producing negative deuterium or tritium ions in amounts suitable for use in controlled thermonuclear reactors.

It is also an object of the invention to provide apparatus for producing negative deuterium or tritium ions which includes an ionization electrode having a surface which is easy to form and reproduce.

SUMMARY OF THE INVENTION

The invention covers a method and apparatus for producing negative ions such as negative deuterium or tritium ions. The negative ions are generated by bombardment of the surface of a novel ionization electrode with energized particles such as positive deuterium ions.

The positive ions interact with a surface layer of the electrode to acquire electrons and form negative ions which then escape from the electrode surface and are accelerated with the aid of an extraction grid. Negative ions produced by the negative ion source of the invention may thereafter be further accelerated and then neutralized to form a high energy beam of neutral particles useful in a controlled thermonuclear reactor.

An important aspect of the invention is the ionization electrode of the negative ion source and particularly the surface layer of the electrode. The surface layer is formed by deposition onto a substrate of the nonvolatile products of thermal decomposition of cesium carbonate such as cesium and cesium peroxide ($Cs_2O_2$). The deposited layer is characterized by a low value of work function of about 1.05 to 1.15 electron volts (eV), which facilitates high yields of negative deuterium ions when the electrode surface is bombarded with positive ions. A low work function of about 1.05 eV is achievable for thin layers and thicker layers as well and for each of several substrate materials. Also, the surface layer of the electrode is easily reproduced or renewed by evaporation from a platinum ribbon coated with cesium carbonate.

DETAILED DESCRIPTION OF PREFERRED EMBODIMENTS OF THE INVENTION

Figure 1:
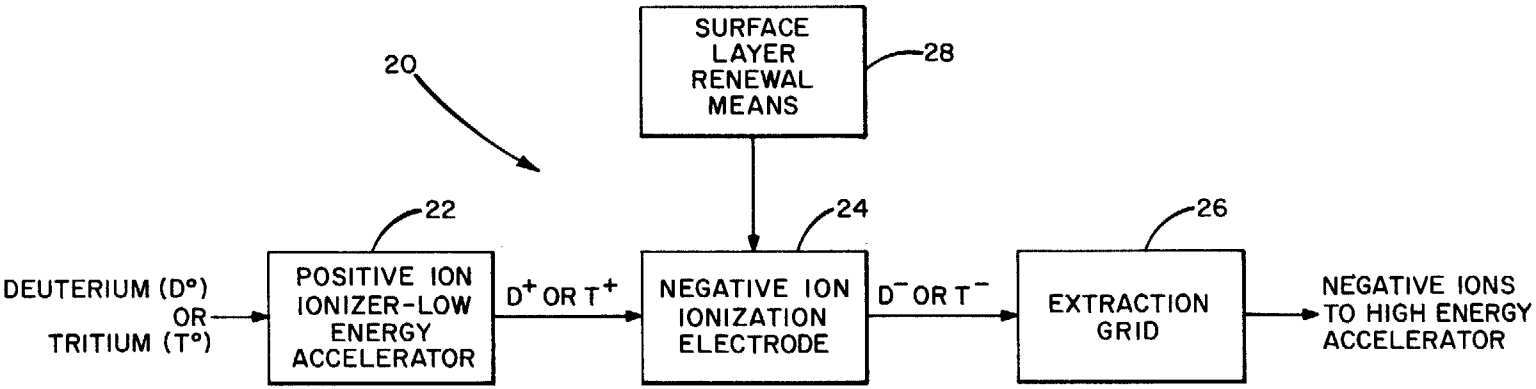
FIG. 1 is a block diagram of a negative ion source according to the invention.

FIG. 1 illustrates in block diagram form the principal components of a negative ion source 20 according to the present invention. Deuterium ($D^{\circ}$) or tritium ($T^{\circ}$) is supplied in a gas to an ionizer low energy accelerator 22. (Hereinafter the invention is described with reference to the production. of negative deuterium ions, it being understood that negative tritium ions may readily be produced by substitution of tritium for deuterium). The ionizer-low energy accelerator 22, which may of conventional design, operates to form positive deuterium ions ($D^+$) by ionizing the gas supplied thereto, then accelerates the positive deuterium ions to energy levels desired for bombardment of an ionization electrode 24. Negatively charged ionization electrode 24 functions as a target for the positive deuterium ions which impinge upon a surface layer of the electrode 24. Interactions between the impinging positive deuterium ions and the surface layer of the electrode cause some of the ions to acquire two electrons, thereby forming negative deuterium ions ($D^-$). Negative ions escaping from the electrode 24 are accelerated by an extraction grid 26 and are then available for further processing and use, as in thermonuclear reactors. Also shown in FIG. 1 as part of the negative ion source 20 are means 28 for renewing or reforming the surface layer of the ionization electrode 24.

Figure 2:
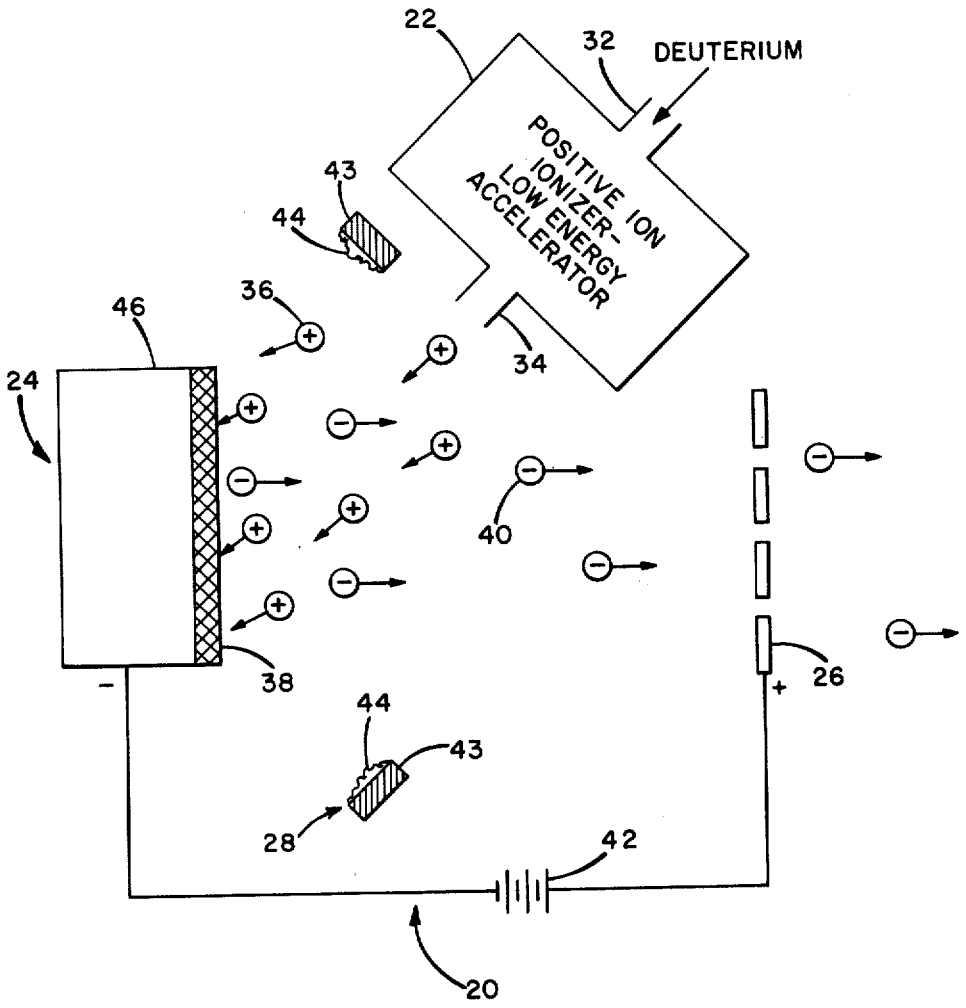
FIG. 2 is a schematic diagram of an apparatus for producing negative deuterium or negative tritium ions according to a preferred embodiment of the invention.

A preferred apparatus for producing negative deuterium ions is shown in schematic form in FIG. 2 wherein like numerals are used to designate components corresponding to those illustrated in FIG. 1. The flow of ions during operation of the apparatus 20 is indicated by circles with appropriate signs and arrows. The negative ion source 20 includes an ionizer-low energy accelerator 22 having an inlet 32 for receiving deuterium and an outlet 34 for directing positive deuterium ions 36 to impinge on a surface layer 38 of an ionization electrode 24. (The structure and properties of the surface layer 38, which are key aspects of the invention, are discussed in greater detail below). The ionizer-accelerator 22 ionizes the deuterium gas to form positive deuterium ions ($D^+$)

and accelerates these positive ions to energy levels sufficient to assure adequate yields of negative deuterium ions 40 from the ionization electrode 24 upon bombardment of the electrode 24 with positive ions 36. These energy levels are preferably at least 50 eV, with energies in the range of 100 to 400 eV being generally suitable.

As shown in FIG. 2, the ionization electrode 24 is electrically connected to the negative terminal of a power source 42 such as a DC battery. The power source 42 supplies electrons for conversion of positive deuterium ions 36 to negative deuterium ions 40 according to the reaction $$D^{+} + 2e^{-} \rightarrow D^{-} \quad (1)$$

which occurs when the surface layer 38 is bombarded with positive deuterium ions. The positive terminal of the power source 26 is connected to an extraction grid 26 which serves to accelerate the negative ions 40 escaping from the surface layer 38. The grid is essentially transparent to the flow of negative ions therethrough.

Also included in the negative source 20 shown in FIG. 2 are means such as a cesium carbonate evaporator 28 for renewing or reforming the surface layer 38 of the ionization electrode 24. The evaporator 28 shown in cross-section in FIG. 2 comprises a ribbon 43 of platinum or nickel formed in the shape of a ring and having a layer 44 of cesium carbonate deposited thereon. The cesium carbonate layer 44 of the evaporator 28 faces in the general direction of the electrode 24 so that when the ribbon 43 is heated—e.g. by a power source (not shown) which provides electrical resistance heating of the ribbon 43—the products of evaporation of the cesium carbonate layer 44 travel along lines approximately normal to the surface of the layer 44 and deposit as a new or refurbished surface layer 38 on the substrate 46 of the ionization electrode 24. The volatile products of the cesium carbonate decomposition are removed by means of an associated vacuum system (not shown).

An important aspect of the present invention is the surface layer 38 of the ionization electrode 24. The surface layer 38 comprises a particular mixture of compounds of cesium and oxygen best specified by their method of preparation as described below. The layer 38 is characterized by a very low value of surface work function $\phi$ of about 1.05-1.15 eV at temperatures of about 450°K, where work function $\phi$ is inversely related to the electron emissivity of a surface and may be determined according to the relationship $$J = AT^2 e^{-\phi/kT} \quad (2)$$

and

J = the thermionic emission current density in amps/cm$^2$ measured at a known temperature T of a sample whose work function is to be determined, T = temperature of the sample (°K), A = a constant (typically 120 amps/(cm°K)$^2$), k = Boltzmann's constant ($8.62 \times 10^{-5}$eV/°K)

e = the base of natural logarithms.

Figure 3:
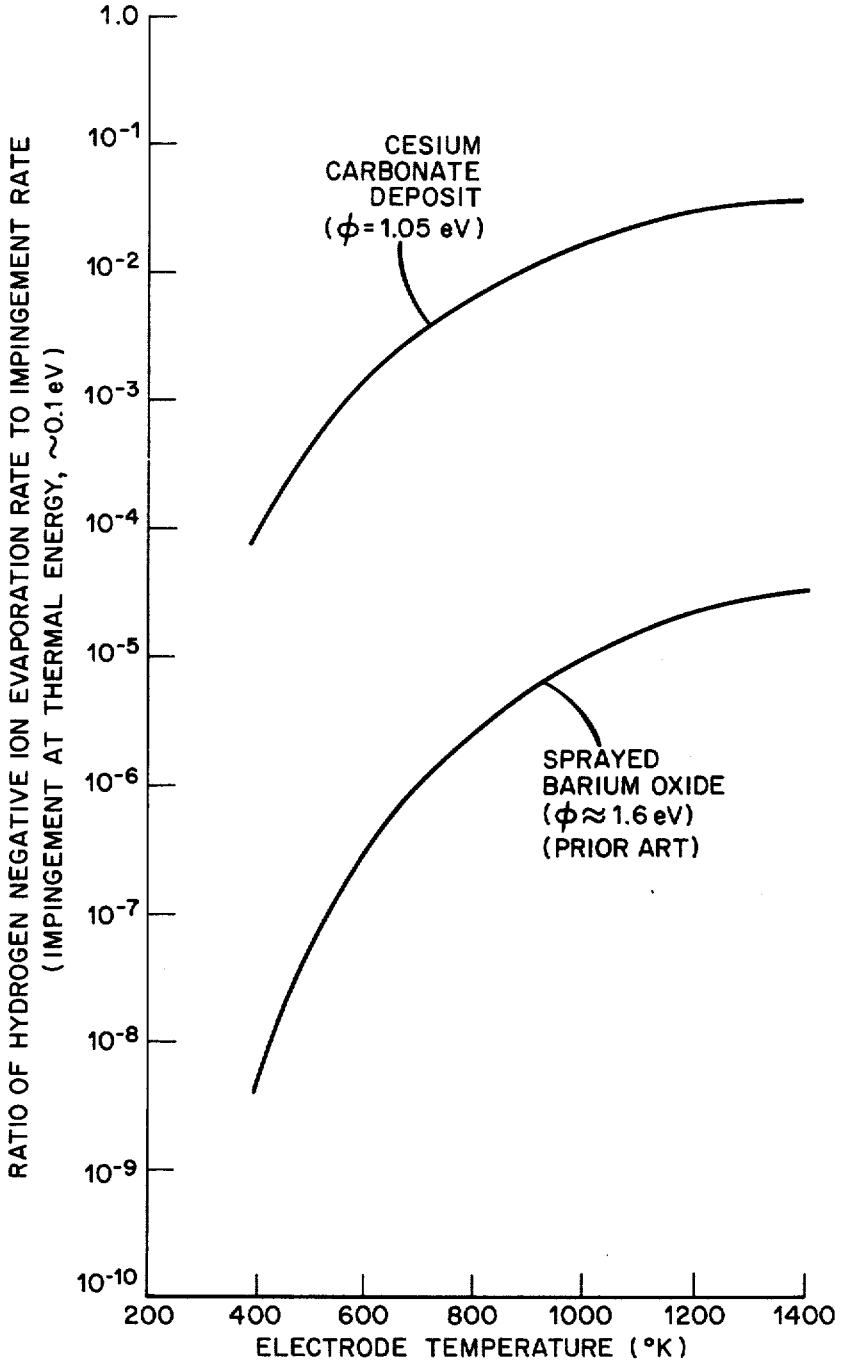
FIG. 3 is a plot illustrating, for systems whose particles have only thermal energy, the predicted ratio of negative ion evaporation rate to particle impingement rate for a high work function prior art surface and the same parameter for a low work function surface suitable for use in the present invention.

The value of work function of the surface layer 38 is important since it has been found that the yield of negative deuterium ions increases as the surface work function of a target electrode decreases. As an indication of this, FIG. 3 shows, for systems whose particles have only thermal energy, the predicted ratio of negative ion evaporation rate to particle impingement rate versus temperature for a prior art barium oxide surface having a work function of approximately 1.6 eV as contrasted to the same parameter for a surface suitable for use in the ionization electrode of the present invention and having a work function of 1.05 eV. The ratios shown are calculated based on an assumption of thermal equilibrium between the electrode and the impinging particles (the impinging and evaporating particles have energies of the order of 0.1 eV). The considerably higher ratio for the surface formed as described in the present invention from the evaporation of cesium carbonate demonstrates its potential superiority for generation of negative ions. The importance of surface work function in the yield of negative ions has been confirmed by this inventor in an analysis of published data on production of negative deuterium ions by backscattering of low energy (order of several hundred eV) positive deuterium ions from alkali metal targets. Results of this analysis clearly indicate that the yield of negative deuterium ions increases as the surface work function of a target decreases. In addition, results of the analysis also shows that the higher deuterium impingement energies used in these studies greatly enhances the measured negative ion yield relative to those calculated in FIG. 3 for thermal impingement energies.

A preferred method of forming the low work function surface layer 38 of the electrode 24 shown in FIG. 2 is as follows. First a solution of cesium carbonate ($Cs_2CO_3$) powder suspended in a volatile organic binder such as butyl acetate —nitrocellulose is sprayed onto a platinum ribbon such as the ribbon 43 shown in FIG. 2. The coated platinum ribbon is placed in a vacuum chamber (e.g. a pressure of about $10^{-8}$ Torr). Next, the ribbon is heated, as by resistance heating a wire attached thereto, to a temperature of about 400° C. to remove the binder yet leave the cesium carbonate on the ribbon 43. A clean substrate of nickel, silver, or other material suitable for use as a cathode is then positioned near the cesium carbonate-coated ribbon, and the ribbon is heated to a temperature about 600° C. The cesium carbonate decomposes at about 600° C. and the nonvolatile decomposition products then condense on the substrate 46 while the carbon dioxide produced during decomposition is removed by vacuum pumping. The surface layer is allowed to grow on the substrate to a desired thickness of at least 100 Å (Angstroms), and then the electrode formed by the substrate and surface layer is connected to the negative terminal of a power source and is ready for use in the production of negative ions.

The surface layer 38 whose fabrication has been described above contains cesium and most likely consists of a mixture of cesium and compounds of cesium and oxygen such as $Cs_2O$ and $Cs_2O_2$. Exact characterization of the surface layer 38 is difficult because this layer is unstable in air and must therefore be studied in the high vacuum environment in which it is formed. Exact analysis is also difficult because the surface layer likely contains a mixture of adsorbed and chemically combined cesium.

Figure 4:
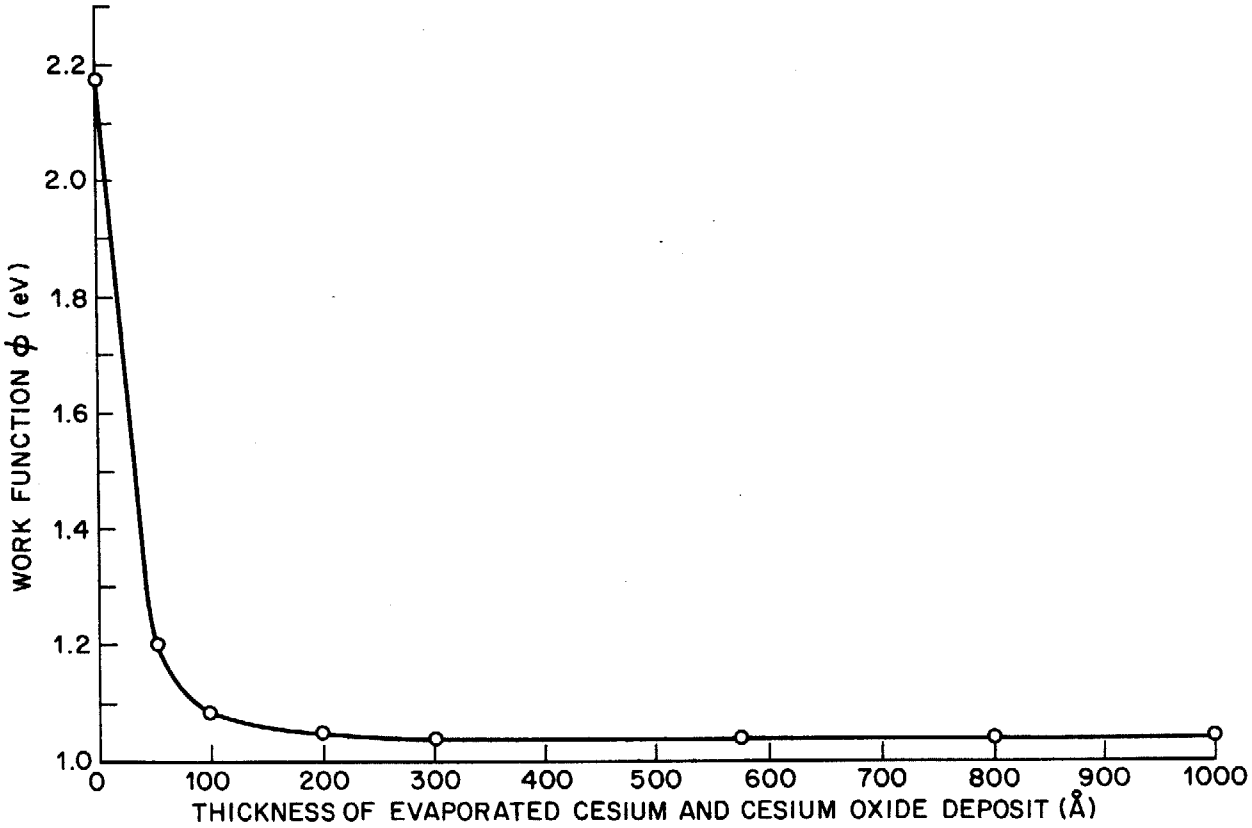
FIG. 4 is a plot of work function versus layer thickness for a preferred surface layer used in an ionization electrode of the invention.

The work function of the layer, however, which as indicated above is a property of great importance, can be accurately and reproducibly determined for the surface layer 38 using equation (2) herein in conjunction with measurements of the thermionic current density produced by the surface layer 38. As shown in FIG. 4, the thus-determined work function for a surface layer formed from the deposition onto a nickel substrate of the nonvolatile decomposition products of cesium carbonate is essentially independent of layer thickness for thicknesses in the range from about 100 to 1000 Å and is equal to a value of about 1.05–1.1 eV at typical operating temperatures of less than or equal to about 450°K. This relative insensitivity of work function to thickness of the surface layer of the ionization electrode 24 facilitates formation of a layer suitable for production of large quantities of negative deuterium ions since layer thickness need not be precisely controlled. Also, relatively thick, long-lasting layers may be used.

Moreover, the work function of the surface layer formed from thermal decomposition of cesium carbonate has also been found to be the same for each of several different materials suitable for use as the substrate 46 of the ionization electrode 24. For example, materials such as silver, mixtures of alkaline—earth metal oxides, lanthanum hexaboride, and thick deposits of the surface layer itself (i.e. of the products of thermal decomposition of cesium carbonate) have been tested as substrates and found to produce electrodes whose surface work functions are quite similar to those employing nickel substrates.

During operation of the apparatus of the invention, a negative ion source such as the source 20 shown in FIG. 2 is enclosed in an air-tight chamber (not shown) and operates at low pressures such as $10^{-4}$ Torr or lower to minimize degradation of the surface layer 38 of the electrode 24 resulting from contact with air. However, since bombardment of the ionization electrode 24 with positive deuterium ions will eventually cause deterioration of the surface layer 38, the negative ion source 20 includes means such as the cesium carbonate evaporator 28 shown in FIG. 2 for replenishing or renewing the surface layer. When renewal is desired, the platinum ribbon 43 of the evaporator 28 is heated to a temperature of about 600° C. This causes the layer 44 of cesium carbonate on the ribbon 43 to vaporize and deposit cesium and compounds of cesium and oxygen on the electrode 24 to renew its low work function surface 38.

Figure 5:
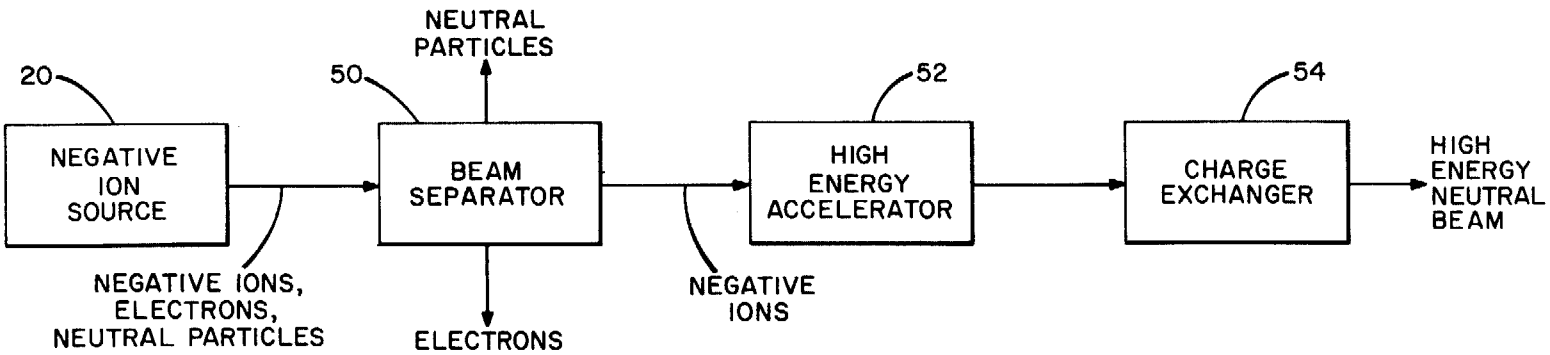
FIG. 5 is a block diagram showing the relationship between the negative ion source of the invention and other components of a neutral beam injector of a controlled thermonuclear reactor.

FIG. 5 is a block diagram illustrating the relationship between the negative ion source 20 of the invention and other major components of a neutral beam injector for a controlled thermonuclear reactor. Since bombardment of the ionization electrode 24 of the invention will produce a beam containing electrons and neutral particles in addition to the negative deuterium ions of interest, a beam separator 50 such as a magnet is positioned to intercept the beam and separate the negative ions from the electrons and neutral particles. The separated negative ions are directed to a high energy accelerator 52 and then to a charge exchanger 54 which converts the negative ions to neutral particles by stripping an electron from each ion. The resulting high energy neutral beam is then injected into a reactor.

Accordingly, there has been disclosed an improved source of negative deuterium and tritium ions based on an ionization electrode having a surface layer which is readily formed from the decomposition products of cesium carbonate, has a very low work function, and is easily renewed.

While the invention has been shown and described with reference to preferred embodiments thereof, it is apparent that the disclosed method and apparatus for producing negative ions may be embodied in other specific forms without departing from the spirit or essential characteristics of the invention. For example, neutral deuterium particles ($D^{\cdot}$) may be used in place of positive deuterium ions ($D^{+}$) for bombardment of the surface layer of the ionization electrode 24 to produce negative ions. Attainment of sufficient bombardment energies for the deuterium may, however, be somewhat more difficult for neutral particles than for positive ions. The scope of the invention is indicated by the appended claims, and all changes which come within the meaning and range of equivalency of these claims are intended to be embraced therein.

What is claimed is:

1. Apparatus for producing negative ions comprising:

an ionization electrode comprising a substrate and a surface layer formed by the deposition on said substrate of products of thermal decomposition of cesium carbonate;

means for supplying positive ions and for directing said positive ions to impinge upon the surface layer of said ionization electrode with a selected level of bombardment energy;

extraction means for accelerating negative ions released from said surface layer following impingement of said positive ions on said layer; and means for replenishing the surface layer of said electrode with the products of decomposition of cesium carbonate.

2. Apparatus as in claim 1 wherein said positive and negative ions are deuterium ions.

3. Apparatus as in claim 1 wherein said positive and negative ions are tritium ions.

4. Apparatus as in claim 1 wherein said surface layer is at least about 100 Angstroms in thickness.

5. Apparatus as in claim 1 wherein said surface layer has a work function less than or equal to 1.1 electron volt.

6. Apparatus as in claim 1 wherein said surface layer has a work function in the range 1.05–1.15 electron volts.

7. Apparatus as in claim 1 wherein said means for replenishing the surface layer of said electrode comprises:

a ribbon having cesium carbonate thereon and located proximate to said electrode to permit deposition of products of evaporation of said cesium carbonate on said electrode; and means for heating said ribbon to thermally decompose said cesium carbonate.

8. Apparatus as in claim 2 wherein said means for supplying positive deuterium ions and for directing said positive ions to impinge upon said surface layer comprises an ionizer-accelerator operable to ionize deuterium furnished thereto to form positive ions and to impart to said positive ions a bombardment energy in the range 50 to 400 electron volts.

* * * * *